US010855020B1

(12) United States Patent
Phillips et al.

(10) Patent No.: US 10,855,020 B1
(45) Date of Patent: Dec. 1, 2020

(54) CARD EDGE CONNECTOR HAVING A CONTACT POSITIONER

(71) Applicant: TE CONNECTIVITY CORPORATION, Berwyn, PA (US)

(72) Inventors: Michael John Phillips, Camp Hill, PA (US); Randall Robert Henry, Lebanon, PA (US)

(73) Assignee: TE CONNECTIVITY CORPORATION, Berwyn, PA (US)

( * ) Notice: Subject to any disclaimer, the term of this patent is extended or adjusted under 35 U.S.C. 154(b) by 0 days.

(21) Appl. No.: 16/573,029

(22) Filed: Sep. 17, 2019

(51) Int. Cl.

| | |
|---|---|
| ***H01R 12/00*** | (2006.01) |
| ***H01R 13/506*** | (2006.01) |
| ***H01R 13/405*** | (2006.01) |
| ***H01R 12/73*** | (2011.01) |

(52) U.S. Cl.
CPC ..... *H01R 13/506* (2013.01); *H01R 12/73* (2013.01); *H01R 13/405* (2013.01)

(58) Field of Classification Search
CPC ..... H01R 12/724; H01R 12/72
USPC ..... 634/634, 637
See application file for complete search history.

(56) References Cited

U.S. PATENT DOCUMENTS

| | | | | |
|---|---|---|---|---|
| 6,565,387 | B2 | 5/2003 | Cohen | |
| 7,175,446 | B2 * | 2/2007 | Bright | H01R 13/6471 439/79 |
| 7,261,591 | B2 * | 8/2007 | Korsunsky | H01R 12/727 439/541 |
| 7,674,133 | B2 * | 3/2010 | Fogg | H01R 13/6587 439/607.07 |
| 8,162,675 | B2 | 4/2012 | Regnier et al. | |
| 8,226,441 | B2 | 7/2012 | Regnier et al. | |
| 8,465,302 | B2 | 6/2013 | Regnier et al. | |
| 8,540,525 | B2 * | 9/2013 | Regnier | H01R 13/6586 439/79 |
| 8,740,644 | B2 * | 6/2014 | Long | H01R 13/6587 439/541.5 |
| 8,753,145 | B2 | 6/2014 | Lang et al. | |
| 8,858,237 | B2 * | 10/2014 | Hsu | H01R 12/724 439/60 |
| 9,065,230 | B2 * | 6/2015 | Milbrand, Jr. | H01R 12/724 |
| 9,277,649 | B2 * | 3/2016 | Ellison | H01R 12/523 |
| 9,306,335 | B2 * | 4/2016 | Fan | H01R 13/6471 |
| 9,478,884 | B2 * | 10/2016 | Tsai | H01R 12/724 |
| 9,768,557 | B2 * | 9/2017 | Phillips | H01R 13/6471 |
| 9,806,468 | B2 * | 10/2017 | Liao | H01R 12/721 |
| 9,837,740 | B2 * | 12/2017 | Liao | H01R 12/775 |

(Continued)

OTHER PUBLICATIONS

Corresponding U.S. Appl. No. 16/242,457, filed Jan. 8, 2019 (39 pages).

*Primary Examiner* — Neil Abrams

(57) ABSTRACT

A card edge connector includes a housing including a card slot open to a cavity and a contact assembly received in the cavity. The contact assembly has a contact positioner holding upper contacts in an upper contact array and lower contacts in a lower contact array. The contact positioner has a positioner card slot. The contacts include intermediate portions extending between mating beams and contact tails. The contact arrays include separate and discrete front and rear contact holders. The front contact holder is positioned between the mating beams and the intermediate portions. The rear contact holder is positioned between the intermediate portions and the contact tails.

20 Claims, 9 Drawing Sheets

(56) References Cited

U.S. PATENT DOCUMENTS

| | | | | |
|---|---|---|---|---|
| 10,374,341 | B1 | 8/2019 | Phillips et al. | |
| 10,403,565 | B1 * | 9/2019 | Henry | H01L 23/49541 |
| 10,454,203 | B2 * | 10/2019 | Phillips | H01R 12/721 |
| 10,461,475 | B2 * | 10/2019 | Little | H01R 13/6658 |
| 10,530,081 | B1 * | 1/2020 | Costello | H01R 12/721 |
| 10,553,971 | B1 * | 2/2020 | Phillips | H01R 12/721 |
| 10,574,002 | B1 * | 2/2020 | Henry | H01R 13/6587 |
| 2012/0225585 | A1 * | 9/2012 | Lee | H01R 13/6474 439/626 |
| 2014/0073181 | A1 * | 3/2014 | Yang | H01R 13/6471 439/607.01 |

* cited by examiner

CARD EDGE CONNECTOR HAVING A CONTACT POSITIONER

BACKGROUND OF THE INVENTION

The subject matter herein relates generally to card edge connectors of communication systems.

Some communication systems utilize communication connectors, such as card edge connectors to interconnect various components of the system for data communication. Some known communication systems use pluggable modules, such as I/O modules or circuit cards, which are electrically connected to the card edge connectors. The pluggable modules have module circuit boards having card edges that are mated with the card edge connectors during the mating operation. Each card edge connector typically has an upper row of contacts and a lower row of contact for mating with the corresponding circuit board. There is a need for connectors and circuit boards of communication systems to have greater contact density and/or data throughput.

Known card edge connectors are not without disadvantages. For instance, the contacts of the card edge connectors are typically curved at the mating ends to provide a large lead-in for the circuit board during mating to prevent mechanical stubbing and damage to the contacts during mating. However, such extra lengths of contacts at the ends of the contacts beyond the mating interfaces of the contacts create electrical stubs that affect the electrical performance of the card edge connectors. Additionally, large sections of the contacts are typically rigidly fixed within the connector housing, such as using a contact overmold to hold the contacts relative to each other and relative to the housing. However, positioning the ends of the contacts for mating to the module circuit board and positioning the ends of the contacts for mounting to the host circuit board is difficult. For example, shifting of the mating ends causes a corresponding shift in the mounting ends, and vice versa.

A need remains for a reliable card edge connector.

BRIEF DESCRIPTION OF THE INVENTION

In one embodiment, a card edge connector for mating with a pluggable module is provided. The card edge connector includes a housing including a top and a bottom. The housing has a front and a rear. The housing has a first side and a second side. The bottom is configured to be mounted to a host circuit board. The housing includes a cavity and a housing card slot open to the cavity at the front of the housing. The housing card slot is configured to receive a card edge of a module circuit board of the pluggable module. The card edge connector includes a contact assembly received in the cavity. The contact assembly has a contact positioner holding upper contacts in an upper contact array and lower contacts in a lower contact array. The contact positioner has an upper wall and a lower wall with a positioner card slot defined therebetween. The contact positioner is positioned in the cavity with the positioner card slot aligned with the housing card slot to receive the card edge of the module circuit board. The upper contacts include upper intermediate portions extending between upper mating beams and upper contact tails. The upper mating beams extend into the positioner card slot to mate with upper mating contacts of the module circuit board. The upper contact tails extend from the contact positioner for mounting to the host circuit board. The upper contact array includes an upper front contact holder holding the upper contacts and an upper rear contact holder separate and discrete from the upper front contact holder holding the upper contacts. The upper front contact holder is positioned between the upper mating beams and the upper intermediate portions of the upper contacts. The upper rear contact holder is positioned between the upper intermediate portions and the upper contact tails of the upper contacts. The lower contacts include lower intermediate portions extending between lower mating beams and lower contact tails. The lower mating beams extend into the positioner card slot to mate with lower mating contacts of the module circuit board. The lower contact tails extend from the contact positioner for mounting to the host circuit board. The lower contact array includes a lower front contact holder holding the lower contacts and a lower rear contact holder separate and discrete from the lower front contact holder holding the lower contacts. The lower front contact holder is positioned between the lower mating beams and the lower intermediate portions of the lower contacts. The lower rear contact holder is positioned between the lower intermediate portions and the lower contact tails of the lower contacts.

In another embodiment, a card edge connector for mating with a pluggable module is provided. The card edge connector includes a housing including a top and a bottom. The housing has a front and a rear. The housing has a first side and a second side. The bottom is configured to be mounted to a host circuit board. The housing includes a cavity and a housing card slot open to the cavity at the front of the housing. The housing card slot is configured to receive a card edge of a module circuit board of the pluggable module. The card edge connector includes a double sided, multi-row contact assembly that is received in the cavity. The double sided, multi-row contact assembly has a contact positioner holding contact arrays of contacts. The contact arrays include a first upper contact array with the contacts thereof arranged in a first upper row, a second upper contact array with the contacts thereof arranged in a second upper row, a first lower contact array with the contacts thereof arranged in a first lower row, and a second lower contact array with the contacts thereof arranged in a second lower row. The contact positioner has an upper wall supporting the first and second upper rows of contacts and a lower wall supporting the first and second lower rows of contacts. The contact positioner includes a positioner card slot between the upper wall and the lower wall. The contact positioner is positioned in the cavity of the outer housing with the positioner card slot aligned with the housing card slot to receive the card edge of the module circuit board. Each contact includes an intermediate portion extending between a mating beam and a contact tail. The mating beams are aligned in the corresponding first and second upper rows and the corresponding first and second lower rows. The mating beams extend into the positioner card slot to mate with the module circuit board. The contact tails extend from the contact positioner for mounting to the host circuit board. Each contact array includes a front contact holder and a rear contact holder separate and discrete from the front contact holder. The front contact holder is positioned between the mating beams and the intermediate portions of the corresponding contacts. The rear contact holder is positioned between the intermediate portions and the contact tails of the corresponding contacts. The front contact holders are movably coupled to the contact positioner. The front contact holders engage the outer housing in the cavity to position the front contact holders relative to the contact positioner. The outer housing positions the mating beams relative to the positioner card slot and the housing card slot for mating with the module circuit board.

In a further embodiment, a card edge connector for mating with a pluggable module is provided. The card edge connector includes a housing including a top and a bottom. The housing has a front and a rear. The housing has a first side and a second side. The bottom is configured to be mounted to a host circuit board. The housing includes a cavity and a housing card slot open to the cavity at the front of the housing. The housing card slot is configured to receive a card edge of a module circuit board of the pluggable module. The card edge connector includes a double sided, multi-row contact assembly received in the cavity. The contact assembly has a contact positioner holding a first upper contact array and a second upper contact array and holding a first lower contact array and a second lower contact array. The contact positioner has an upper wall and a lower wall with a positioner card slot defined therebetween. The contact positioner is positioned in the cavity with the positioner card slot aligned with the housing card slot to receive the card edge of the module circuit board. The first upper contact array includes first upper contacts, a first upper front contact holder, and a first upper rear contact holder. The first upper rear contact holder is separate and discrete from the first upper front contact holder. The first upper contacts include first upper intermediate portions extending between first upper mating beams and first upper contact tails. The first upper mating beams are arranged in a first upper row and extend into the positioner card slot to mate with first upper mating contacts of the module circuit board. The first upper contact tails extend from the contact positioner for mounting to the host circuit board. The first upper front contact holder is positioned between the first upper mating beams and the first upper intermediate portions to hold each of the first upper contacts. The first upper rear contact holder is positioned between the first upper intermediate portions and the first upper contact tails to hold each of the first upper contacts. The second upper contact array includes second upper contacts, a second upper front contact holder, and a second upper rear contact holder. The second upper rear contact holder is separate and discrete from the second upper front contact holder. The second upper contacts include second upper intermediate portions extending between second upper mating beams and second upper contact tails. The second upper mating beams are arranged in a second upper row parallel to and spaced apart from the first upper row. The second upper mating beams extend into the positioner card slot to mate with second upper mating contacts of the module circuit board. The second upper contact tails extend from the contact positioner for mounting to the host circuit board. The second upper front contact holder is positioned between the second upper mating beams. The second upper intermediate portions hold each of the second upper contacts. The second upper rear contact holder is positioned between the second upper intermediate portions. The second upper contact tails hold each of the second upper contacts. The first lower contact array includes first lower contacts, a first lower front contact holder, and a first lower rear contact holder. The first lower rear contact holder is separate and discrete from the first lower front contact holder. The first lower contacts include first lower intermediate portions extending between first lower mating beams and first lower contact tails. The first lower mating beams are arranged in a first lower row and extend into the positioner card slot to mate with first lower mating contacts of the module circuit board. The first lower contact tails extend from the contact positioner for mounting to the host circuit board. The first lower front contact holder is positioned between the first lower mating beams. The first lower intermediate portions hold each of the first lower contacts. The first lower rear contact holder is positioned between the first lower intermediate portions. The first lower contact tails hold each of the first lower contacts. The second lower contact array includes second lower contacts, a second lower front contact holder, and a second lower rear contact holder. The second lower rear contact holder is separate and discrete from the second lower front contact holder. The second lower contacts include second lower intermediate portions extending between second lower mating beams and second lower contact tails. The second lower mating beams are arranged in a second lower row parallel to and spaced apart from the first lower row. The second lower mating beams extend into the positioner card slot to mate with second lower mating contacts of the module circuit board. The second lower contact tails extend from the contact positioner for mounting to the host circuit board. The second lower front contact holder is positioned between the second lower mating beams. The second lower intermediate portions hold each of the second lower contacts. The second lower rear contact holder is positioned between the second lower intermediate portions. The second lower contact tails hold each of the second lower contacts.

DETAILED DESCRIPTION OF THE INVENTION

Figure 1:
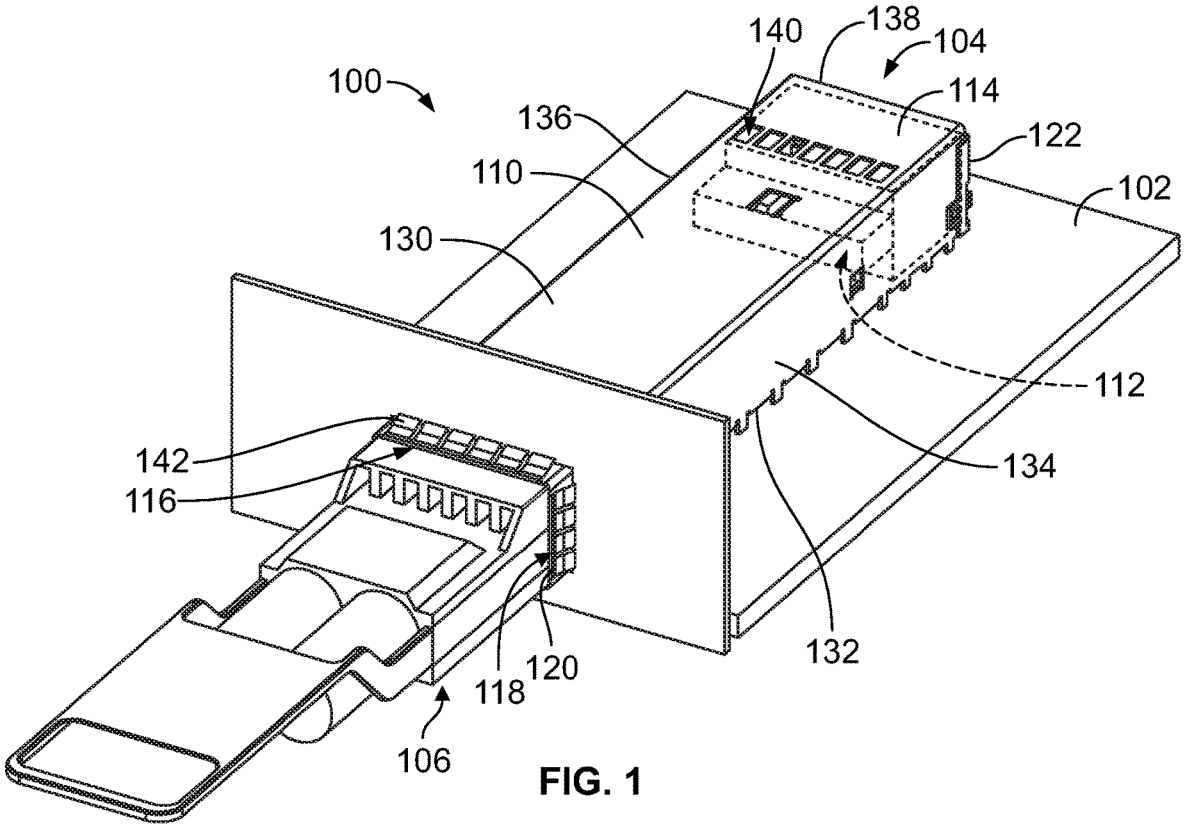
FIG. 1 is a front perspective view of a communication system formed in accordance with an exemplary embodiment.

FIG. 1 is a front perspective view of a communication system 100 formed in accordance with an exemplary embodiment. The communication system includes a host circuit board 102 and a receptacle connector assembly 104 mounted to the host circuit board 102. A pluggable module 106 (fully shown in FIG. 2) is configured to be electrically connected to the receptacle connector assembly 104. The pluggable module 106 is electrically connected to the host circuit board 102 through the receptacle connector assembly 104.

In an exemplary embodiment, the receptacle connector assembly 104 includes a receptacle cage 110 and a card edge connector 112 (shown with phantom lines) adjacent the receptacle cage 110. For example, in the illustrated embodiment, the card edge connector 112 is received in the receptacle cage 110. In other various embodiments, the card edge connector 112 may be located rearward of the receptacle cage 110. In various embodiments, the receptacle cage 110 is enclosed and provides electrical shielding for the card edge connector 112. The pluggable modules 106 are loaded into the receptacle cage 110 and are at least partially surrounded by the receptacle cage 110. In an exemplary embodiment, the receptacle cage 110 is a shielding, stamped and formed cage member that includes a plurality of shielding walls 114 that define one or more module channels for receipt of corresponding pluggable modules 106. In other embodiments, the receptacle cage 110 may be open between frame members to provide cooling airflow for the pluggable modules 106 with the frame members of the receptacle cage 110 defining guide tracks for guiding loading of the pluggable modules 106 into the receptacle cage 110. In other various embodiments, the receptacle connector assembly 104 may be provided without the receptacle cage 110, rather only including the card edge connector 112. In the illustrated embodiment, the card edge connector 112 is oriented for horizontal mating (for example, parallel to the host circuit board 102). In other various embodiments, the card edge connector 112 is oriented for vertical mating (for example, perpendicular to the host circuit board 102).

In the illustrated embodiment, the receptacle cage 110 is a single port receptacle cage configured to receive a single pluggable module 106. In other various embodiments, the receptacle cage 110 may be a ganged cage member having a plurality of ports ganged together in a single row and/or a stacked cage member having multiple ports stacked as an upper port and a lower port. The receptacle cage 110 includes a module channel 116 having a module port 118 open to the module channel 116. The module channel 116 receives the pluggable module 106 through the module port 118. In an exemplary embodiment, the receptacle cage 110 extends between a front end 120 and a rear end 122. The module port 118 is provided at the front end 120. Any number of module channels 116 may be provided in various embodiments arranged in a single column or in multiple columns (for example, 2×2, 3×2, 4×2, 4×3, 4×1, 2×1, and the like). Optionally, multiple card edge connectors 112 may be arranged within the receptacle cage 110, such as when multiple rows and/or columns of module channels 116 are provided.

In an exemplary embodiment, the walls 114 of the receptacle cage 110 include a top wall 130, a bottom wall 132, a first side wall 134 and a second side wall 136 extending from the top wall 130. The bottom wall 132 may rest on the host circuit board 102. In other various embodiments, the receptacle cage 110 may be provided without the bottom wall 132. Optionally, the walls 114 of the receptacle cage 110 may include a rear wall 138 at the rear end 122. The walls 114 define a cavity 140. For example, the cavity 140 may be defined by the top wall 130, the bottom wall 132, the side walls 134, 136 and the rear wall 138. The cavity 140 includes the module channel 116. In various embodiments, the cavity 140 receives the card edge connector 112, such as at the rear end 122. Other walls 114 may separate or divide the cavity 140 into additional module channels 116, such as in embodiments using ganged and/or stacked receptacle cages. For example, the walls 114 may include one or more vertical divider walls between ganged module channels 116. In various embodiments, the walls 114 may include a separator panel between stacked upper and lower module channels 116. The separator panel may include an upper panel and a lower panel that form a space between the upper and lower module channels 116, such as for airflow, for a heat sink, for routing light pipes, or for other purposes.

In an exemplary embodiment, the receptacle cage 110 may include one or more gaskets 142 at the front end 120 for providing electrical shielding for the module channels 116. For example, the gaskets 142 may be provided at the port 118 to electrically connect with the pluggable modules 106 received in the module channel 116. Optionally, the pluggable module 106 may include a gasket that engages the receptacle cage 110 rather than the receptacle cage 110 having a gasket that engages the pluggable module 106. In an exemplary embodiment, the gaskets 142 may be provided around the exterior of the receptacle cage 110 for interfacing with a panel (not shown), such as when the front end 120 of the receptacle cage 110 extends through a cutout in the panel. The gaskets 142 may include spring fingers or other deflectable features that are configured to be spring biased against the panel to create an electrical connection with the panel.

Optionally, the receptacle connector assembly 104 may include one or more heat sinks (not shown) for dissipating heat from the pluggable modules 106. For example, the heat sink may be coupled to the top wall 130 for engaging the pluggable module 106 received in the module channel 116. The heat sink may extend through an opening in the top wall 130 to directly engage the pluggable module 106. Other types of heat sinks may be provided in alternative embodiments.

In an exemplary embodiment, the card edge connector 112 is received in the cavity 140, such as proximate to the rear wall 138. However, in alternative embodiments, the card edge connector 112 may be located behind the rear wall 138 exterior of the receptacle cage 110 and extend into the cavity 140 to interface with the pluggable module(s) 106. In an exemplary embodiment, a single card edge connector 112 is provided. In alternative embodiments, the communication system 100 may include multiple card edge connectors 112 (for example, for stacked and/or ganged receptacle cages) for mating with corresponding pluggable modules 106.

In an exemplary embodiment, the pluggable modules 106 are loaded through the port 118 at the front end 120 to mate with the card edge connector 112. The shielding walls 114 of the receptacle cage 110 provide electrical shielding around the card edge connector 112 and the pluggable module 106, such as around the mating interface between the card edge connector 112 and the pluggable module 106.

Figure 2:
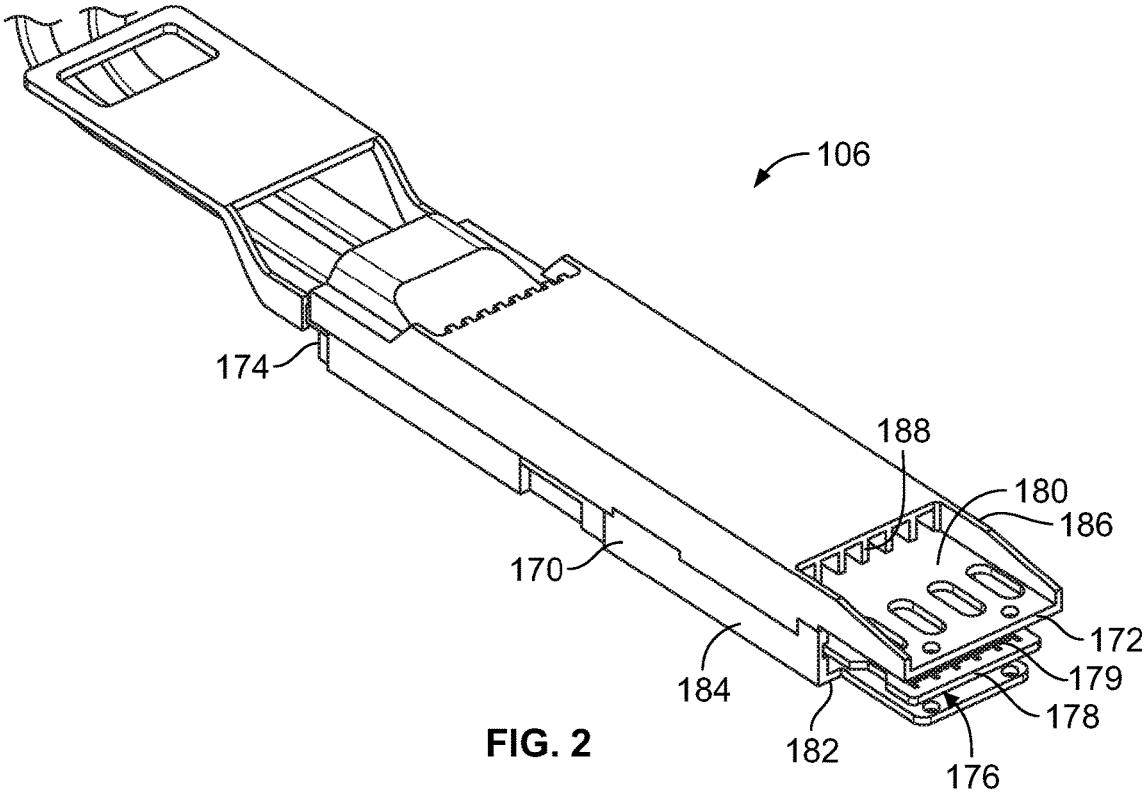
FIG. 2 is a rear perspective view of a pluggable module of the communication system in accordance with an exemplary embodiment.

FIG. 2 is a rear perspective view of the pluggable module 106 in accordance with an exemplary embodiment. The pluggable module 106 has a pluggable body 170, which may be defined by one or more shells. The pluggable body 170 may be thermally conductive and/or may be electrically conductive, such as to provide EMI shielding for the pluggable module 106. The pluggable body 170 includes a mating end 172 and an opposite front end 174. The mating end 172 is configured to be inserted into the corresponding module channel 116 (shown in FIG. 1). The front end 174 may be a cable end having a cable extending therefrom to another component within the system.

The pluggable module 106 includes a module circuit board 176 that is configured to be communicatively coupled to the card edge connector 112 (shown in FIG. 1). The module circuit board 176 may be accessible at the mating end 172. The module circuit board 176 has a card edge 178 extending between a first or upper surface and a second or lower surface at a mating end of the module circuit board 176. The module circuit board 176 includes mating contacts 179, such as pads or circuits, at the card edge 178 configured to be mated with the card edge connector 112. In an exemplary embodiment, the mating contacts 179 are provided on the upper surface and the lower surface. The module circuit board 176 may include components, circuits and the like used for operating and or using the pluggable module 106. For example, the module circuit board 176 may have conductors, traces, pads, electronics, sensors, controllers, switches, inputs, outputs, and the like associated with the module circuit board 176, which may be mounted to the module circuit board 176, to form various circuits.

The pluggable module 106 includes an outer perimeter defining an exterior of the pluggable body 170. For example, the outer perimeter may be defined by a top 180, a bottom 182, a first side 184 and a second side 186. The pluggable body 170 may have other shapes in alternative embodiments. In an exemplary embodiment, the pluggable body 170 provides heat transfer for the module circuit board 176, such as for the electronic components on the module circuit board 176. For example, the module circuit board 176 is in thermal communication with the pluggable body 170 and the pluggable body 170 transfers heat from the module circuit board 176. Optionally, the pluggable body 170 may include a plurality of heat transfer fins 188 along at least a portion of the outer perimeter, such as the top 180, of the pluggable module 106 for dissipating heat from the pluggable body 170.

In other various embodiments, the pluggable module 106 may be a circuit card rather than an I/O module. For example, the pluggable module 106 may include the module circuit board 176 without the pluggable body 170 surrounding the module circuit board 176.

Figure 3:
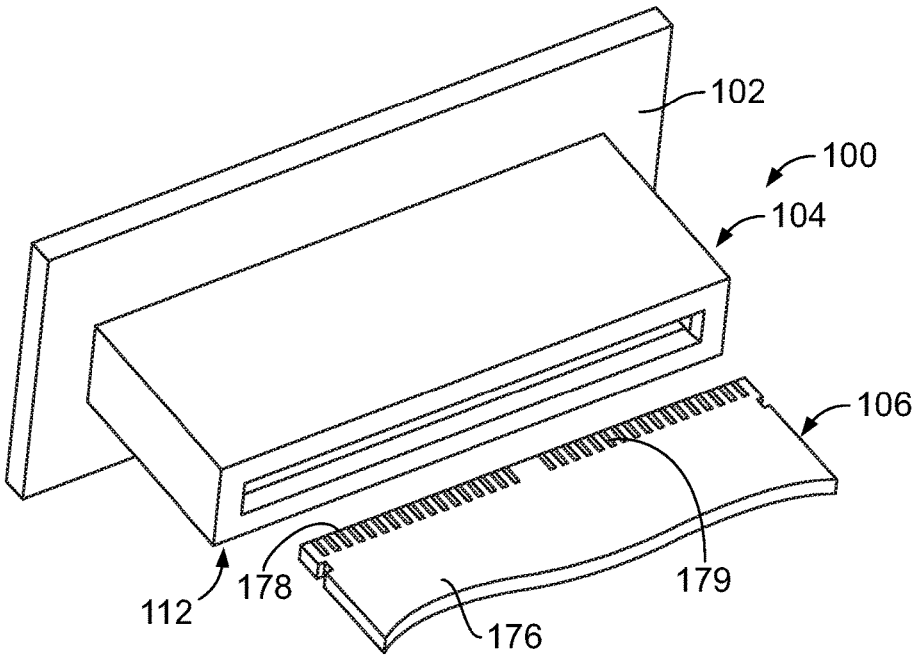
FIG. 3 is a front perspective view of the communication system in accordance with an exemplary embodiment.

FIG. 3 is a front perspective view of the communication system 100 in accordance with an exemplary embodiment. The receptacle connector assembly 104 is shown as a card edge connector 112 mounted to the host circuit board 102 (without a receptacle cage). The card edge connector 112 may be mounted horizontally or vertically in various embodiments. The card edge connector 112 may be mounted to the circuit board 102 to receive the pluggable module 106 in a direction perpendicular to the circuit board 102 in various embodiments. In alternative embodiments, the card edge connector 112 may be a right-angle card edge connector mounted to the circuit board 102 to receive the pluggable module 106 in a direction parallel to the circuit board 102. In the illustrated embodiment, the receptacle connector assembly 104 is a pass-through connector having the mating end and the mounting end of the housing parallel to each other rather than perpendicular to each other such that the contacts pass straight through the housing rather than being right angle contacts.

In the illustrated embodiment, the pluggable module 106 includes the module circuit board 176 without the outer pluggable body (shown in FIG. 2) holding the module circuit board 176. The module circuit board 176 includes the card edge 178 between a first or upper surface and a second or lower surface at a mating end of the module circuit board 176. The module circuit board 176 includes the mating contacts 179 at the card edge 178, such as at both the upper surface and the lower surface, configured to be mated with the contacts of the card edge connector 112.

Figure 4:
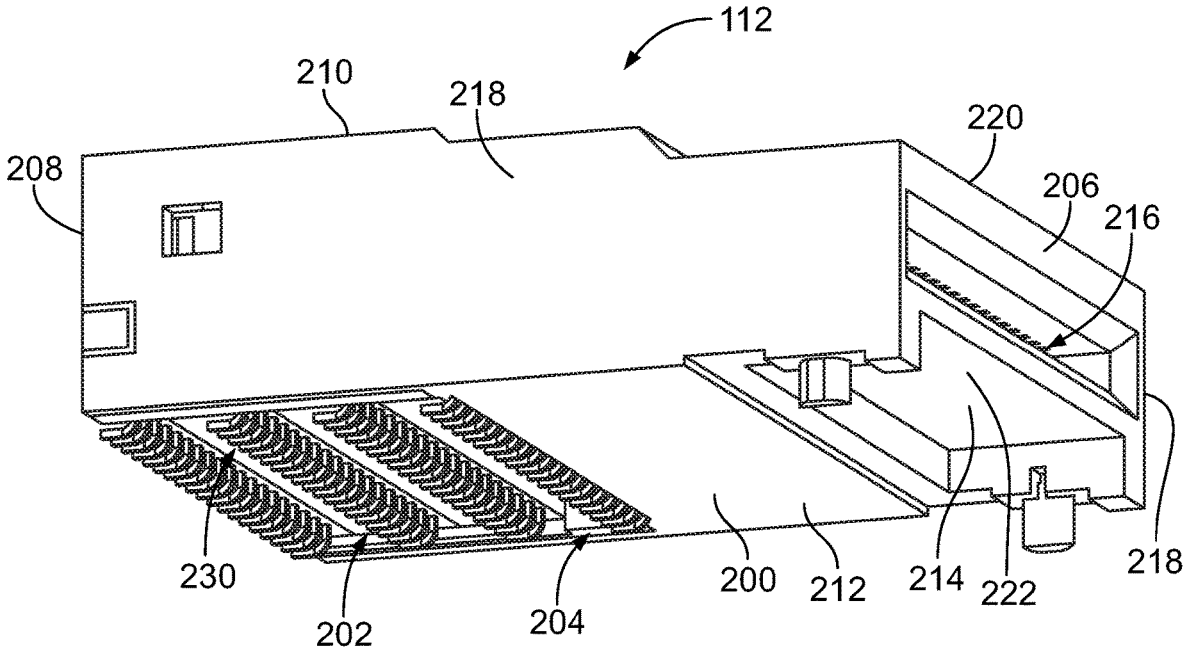
FIG. 4 is a bottom perspective view of a card edge connector of the communication system in accordance with an exemplary embodiment.
Figure 5:
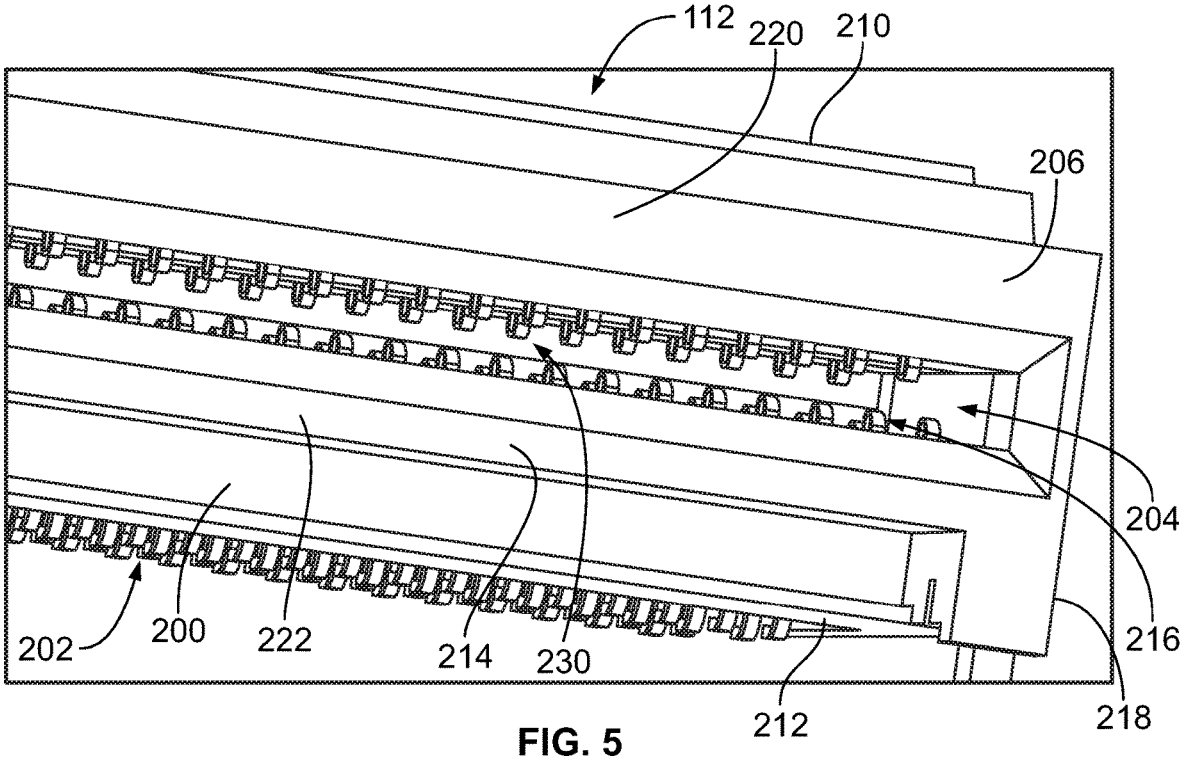
FIG. 5 is a front perspective view of a portion of the card edge connector in accordance with an exemplary embodiment.

FIG. 4 is a bottom perspective view of the card edge connector 112 in accordance with an exemplary embodiment. FIG. 5 is a front perspective view of a portion of the card edge connector 112 in accordance with an exemplary embodiment. The card edge connector 112 includes an outer housing 200 having a contact assembly 202 received in a cavity 204 of the outer housing 200. The outer housing 200 extends between a front 206 and a rear 208. The outer housing 200 extends between a top 210 and a bottom 212. The outer housing 200 extends between opposite sides 218. The outer housing 200 may be generally box shaped in various embodiments. In the illustrated embodiment, the bottom 212 defines a mounting end configured to be mounted to the host circuit board 102 (shown in FIG. 1) and the front 206 defines the mating end configured to be mated with the pluggable module 106 (shown in FIG. 1). Other orientations are possible in alternative embodiments.

The outer housing 200 includes a top wall 220 at the top 210 and a bottom wall 222 at the bottom 212. In the illustrated embodiment, the outer housing 200 includes a shroud 214 at the front 206 configured to be mated with the pluggable module 106. The shroud 214 is configured to be received in the pluggable module 106. The outer housing 200 includes a housing card slot 216 at the front 206. For example, the housing card slot 216 may be located in the shroud 214 and open at the front of the shroud 214. The housing card slot 216 receives the card edge 178 (shown in FIG. 2) of the module circuit board 176 (shown in FIG. 2).

Figure 6:
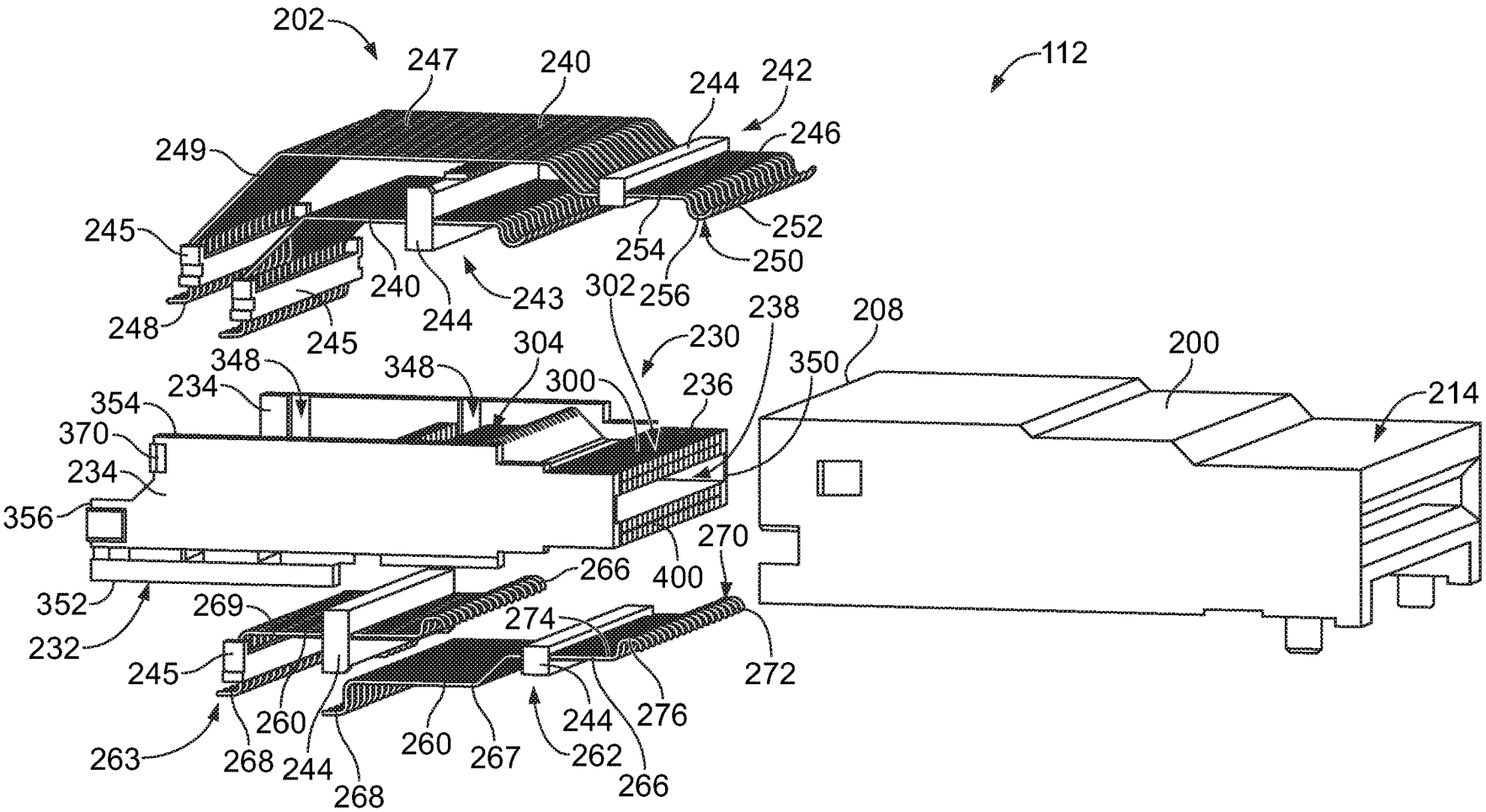
FIG. 6 is an exploded view of the card edge connector in accordance with an exemplary embodiment.

FIG. 6 is an exploded view of the card edge connector 112 in accordance with an exemplary embodiment. In an exemplary embodiment, the contact assembly 202 is a double-sided, multi-row contact assembly. For example, the contact assembly 202 includes upper contacts 240 and lower contacts 260 arranged on opposite sides of the card slot. The upper contacts 240 are arranged in multiple rows and the lower contacts 260 are arranged in multiple rows. As such, the card edge connector 112 has high density and significant data throughput.

The contact assembly 202 includes a contact positioner 230 supporting the upper contacts 240 and the lower contacts 260. In an exemplary embodiment, the upper contacts 240 are arranged in a first upper contact array 242 and a second upper contact array 243. The upper contact arrays 242, 243 may be leadframes having stamped and formed contacts forming the upper contacts 240. The mating ends of the upper contacts 240 of the first upper contact array 242 are arranged in a first upper row and the mating ends of the upper contacts 240 of the second upper contact array 243 are arranged in a second upper row parallel to and spaced apart from the first upper row. The mounting ends of the upper contacts 240 of the first upper contact array 242 are arranged in a first row and the mounting ends of the upper contacts 240 of the second upper contact array 243 are arranged in a second row parallel to and spaced apart from the first row. In an exemplary embodiment, the lower contacts 260 are arranged in a first lower contact array 262 and a second lower contact array 263. The lower contact arrays 262, 263 may be leadframes having stamped and formed contacts forming the lower contacts 260. The mating ends of the lower contacts 260 of the first lower contact array 262 are arranged in a first lower row and the mating ends of the lower contacts 260 of the second lower contact array 263 are arranged in a second lower row parallel to and spaced apart from the first lower row. The mounting ends of the lower contacts 260 of the first lower contact array 262 are arranged in a first row and the mounting ends of the lower contacts 260 of the second lower contact array 263 are arranged in a second row parallel to and spaced apart from the first row.

The contact positioner 230 is used to position the upper and lower contacts 240, 260 relative to each other. The contact positioner 230 is used to hold the contact arrays for loading the contact assembly 202 into the outer housing 200. In an exemplary embodiment, the contacts 240, 260 are movable relative to the contact positioner 230 for proper alignment and positioning for mating with the pluggable module 106 and mounting to the host circuit board 102. In various embodiments, the outer housing 200 is used to properly position the contacts 240, 260.

In an exemplary embodiment, the contacts 240, 260 are held by contact holders. For example, the contact arrays 242, 243, 262, 263 include a front contact holder 244 and/or a rear contact holder 245. The front contact holder 244 is positioned proximate to front ends of the contacts 240, 260. The rear contact holder 245 is positioned proximate to rear ends of the contacts 240, 260. The contact holders 244, 245 encase portions of the contacts 240, 260. In various embodiments, the contact holders 244, 245 are dielectric bodies, such as overmold bodies that are overmolded around portions of the contacts 240, 260, to hold the relative positions of the front and rear ends of the contacts 240, 260, such as for loading the contacts 240, 260 into the contact positioner 230. In an exemplary embodiment, the front and rear contact holders 244, 245 are spaced apart from each other. For example, sections of the contacts 240, 260 extend, un-encased, between the contact holders 244, 245. The contacts 240, 260 are independently and freely movable between the contact holders 244, 245. For example, portions of the contacts 240, 260 may be flexed, compressed, shifted, or otherwise moved relative to each other to position the mating ends and the mounting ends within the contact positioner 230.

The contact holders 244, 245 are coupled to the contact positioner 230 to load the upper and lower contacts 240, 260 in the contact positioner 230 to form the contact assembly 202. The assembled contact assembly 202 is configured to be loaded into the outer housing 200, such as through the rear 208 of the outer housing 200.

The contact positioner 230 includes a base 232, arms 234 extending from the base 232 and a nose 236 between the arms 234. The contact positioner 230 has a positioner card slot 238 in the nose 236. The positioner card slot 238 receives the card edge 178 of the module circuit board 176. The base 232 holds the upper and lower contacts 240, 260. For example, the base 232 may hold the rear contact holders 245. The nose 236 holds the upper and lower contacts 240, 260. For example, the nose 236 may hold the front contact holders 244. The upper and lower contacts 240, 260 are loaded into the base 232 and into the nose 236 to position the upper and lower contacts 240, 260 for mating with the module circuit board 176 (shown in FIG. 2) and for mounting to the host circuit board 102 (shown in FIG. 1).

In an exemplary embodiment, the nose 236 of the contact positioner 230 is used to pre-load each of the upper and lower contacts 240, 260 with an internal spring biasing force for mating with the module circuit board 176. Pre-loading the upper and lower contacts 240, 260 causes the upper and lower contacts 240, 260 to be biased against the module circuit board 176 to ensure that the electrical connection between the upper and lower contacts 240, 260 and the module circuit board 176 is maintained. The upper and lower contacts 240, 260 are flexed outward by the module circuit board 176 when the module circuit board 176 is loaded in the positioner card slot 238. The internal biasing force, pre-loaded within the upper and lower contacts 240, 260, ensures that sufficient contact force is provided with small flexing of the upper and lower contacts 240, 260 by the module circuit board 176.

Each upper contact 240 includes a transition portion 247 extending between a mating beam 246 at a mating end and a contact tail 248 at a terminating end. The front contact holder 244 supports the mating beams 246 of the upper contacts 240. For example, the front contact holder 244 is provided at the mating beams 246 and/or the transition portions 247. Optionally, portions of the mating beams 246 and/or front portions of the transition portions 247 may be encased in the front contact holder 244. The mating beams 246 extend forward of the front contact holder 244 for mating with the module circuit board 176. The mating beams 246 are configured to be coupled to the nose 236. The mating beams 246 may extend into the shroud 214 for mating with the module circuit board 176.

The rear contact holder 245 supports the contact tails 248 of the upper contacts 240. For example, the rear contact holder 245 is provided at the contact tails 248 and/or the transition portions 247. Optionally, portions of the contact tails 248 and/or rear portions of the transition portions 247 may be encased in the rear contact holder 245. The contact tails 248 extend from the rear contact holder 245 for termination to the host circuit board 102. For example, the contact tails 248 may be solder tails configured to be soldered to the host circuit board 102. The contact tails 248 may be coupled to the base 232.

In an exemplary embodiment, each upper contact 240 includes an intermediate portion 249 extending between the front contact holder 244 and the rear contact holder 245. The intermediate portion 249 is the un-encased section of the transition portion 247. The intermediate portions 249 may be bent along various sections to transition between the front and rear contact holders 244, 245.

Various upper contacts 240 may be signal contacts and other upper contacts 240 may be ground contacts, such as interspersed between signal contacts or pairs of signal contacts. In an exemplary embodiment, the upper contacts 240 are flexible and configured to be elastically deformed and flexed, such as during assembly and during mating with the module circuit board 176. For example, the intermediate portions 249 may be flexed between the front and rear contact holders 244, 245, such as for relative positioning of the mating beams 246 and the contact tails 248. The mating beams 246 may be cantilevered spring beams extending forward from the front contact holder 244 configured to be flexed when mated with the module circuit board 176. The contact tails 248 may be flexed when mounted to the host circuit board 102.

In an exemplary embodiment, the mating beam 246 includes a mating interface 250 at a tip 252 of the upper contact 240. For example, the spring beam defining the mating beam 246 includes an arm 254 and a finger 256 extending from the arm 254 to the tip 252. The arm 254 extends generally forwardly (for example, horizontally) and the finger 256 extends generally inward (for example, vertically) from the arm 254. The finger 256 may be curved and extend both inwardly from the arm 254 to the mating interface 250 and outwardly to the tip 252. The finger 256 may have a flat section between the curved sections to define the mating interface 250. In other various embodiments, the upper contact 240 may end at the mating interface 250 with the tip 252 at the mating interface 250 and does not create an electrical stub beyond the mating interface 250. For example, the upper contact 240 does not include a flared lead-in beyond the mating interface 250 as is common with conventional contacts.

Each lower contact 260 includes a transition portion 267 extending between a mating beam 266 at a mating end and a contact tail 268 at a terminating end. The front contact holder 244 supports the mating beams 266 of the lower contacts 260. For example, the front contact holder 244 is provided at the mating beams 266 and/or the transition portions 267. Optionally, portions of the mating beams 266 and/or front portions of the transition portions 267 may be encased in the front contact holder 244. The mating beams 266 extend forward of the front contact holder 244 for mating with the module circuit board 176. The mating beams 266 are configured to be coupled to the nose 236. The mating beams 266 may extend into the shroud 214 for mating with the module circuit board 176.

The rear contact holder 245 supports the contact tails 268 of the lower contacts 260. For example, the rear contact holder 245 is provided at the contact tails 268 and/or the transition portions 267. Optionally, portions of the contact tails 268 and/or rear portions of the transition portions 267 may be encased in the rear contact holder 245. The contact tails 268 extend from the rear contact holder 245 for termination to the host circuit board 102. For example, the contact tails 268 may be solder tails configured to be soldered to the host circuit board 102. The contact tails 268 may be coupled to the base 232.

In an exemplary embodiment, each lower contact 260 includes an intermediate portion 269 extending between the front contact holder 244 and the rear contact holder 245. The intermediate portion 269 is the un-encased section of the transition portion 267. The intermediate portions 269 may be bent along various sections to transition between the front and rear contact holders 244, 245.

Various lower contacts 260 may be signal contacts and other lower contacts 260 may be ground contacts, such as interspersed between signal contacts or pairs of signal contacts. In an exemplary embodiment, the lower contacts 260 are flexible and configured to be elastically deformed and flexed, such as during assembly and during mating with the module circuit board 176. For example, the intermediate portions 269 may be flexed between the front and rear contact holders 244, 245, such as for relative positioning of the mating beams 266 and the contact tails 268. The mating beams 266 may be cantilevered spring beams extending forward from the front contact holder 244 configured to be flexed when mated with the module circuit board 176. The contact tails 268 may be flexed when mounted to the host circuit board 102.

In an exemplary embodiment, the mating beam 266 includes a mating interface 270 at a tip 272 of the lower contact 260. For example, the spring beam defining the mating beam 266 includes an arm 274 and a finger 276 extending from the arm 274 to the tip 272. The arm 274 extends generally forwardly (for example, horizontally) and the finger 276 extends generally inward (for example, vertically) from the arm 274. The finger 276 may be curved and extend both inwardly from the arm 274 to the mating interface 270 and outwardly to the tip 272. The finger 276 may have a flat section between the curved sections to define the mating interface 270. In other various embodiments, the lower contact 260 may end at the mating interface 270 with the tip 272 at the mating interface 270 and does not create an electrical stub beyond the mating interface 270. For example, the lower contact 260 does not include a flared lead-in beyond the mating interface 270 as is common with conventional contacts.

The upper and lower contact holders 244, 245 are coupled to the contact positioner 230 to load the upper and lower contacts 240, 260 into the contact positioner 230. In the illustrated embodiment, the transition portions 247, 267 are bent through a 90 degree transition from the mating beams 246, 266 to the contact tails 248, 268. Other orientations are possible in alternative embodiments.

In an exemplary embodiment, the arms 234 extend forward from the base 232 to support the nose 236. The arms 234 and/or the base 232 and/or the nose 236 include slots 348 that receive the contact holders 244, 245. The slots 348 may be open at the top to receive the contact holders 244, 245 of the upper contact arrays 242, 243 and the slots 348 may be open at the bottom to receive the contact holders 244, 245 of the lower contact arrays 262, 263.

In an exemplary embodiment, the contact positioner 230 is a right-angle contact positioner having a mating end at a front wall 350 of the contact positioner 230 and a mounting end at a bottom 352 of the contact positioner 230. The base 232 is provided at the bottom 352. The nose 236 extends to the front wall 350. Other orientations are possible in alternative embodiments, such as with the nose 236 at a top 354 of the contact positioner 230 and/or the base 232 at a rear 356 of the contact positioner 230.

In an exemplary embodiment, the contact positioner 230 includes securing features 370 for securing the contact positioner 230 in the outer housing 200. The securing features 370 may be latches or other types of securing features. The securing features 370 may be provided on the arms 234 and/or the base 232 and/or the nose 236.

The nose 236 includes an upper wall 300 and a lower wall 400. The positioner card slot 238 is located between the upper wall 300 and the lower wall 400. The upper wall 300 receives and supports the mating beams 246 of the upper contacts 240. The lower wall 400 receives and supports the mating beams 266 of the lower contacts 260. In an exemplary embodiment, the upper wall 300 includes a forward mounting area 302 for receiving the mating beams 246 of the front upper contact array 242 and a rearward mounting area 304 for receiving the mating beams 246 of the rear upper contact array 243. The lower wall 400 includes similar front and rear mounting areas.

Figure 7:
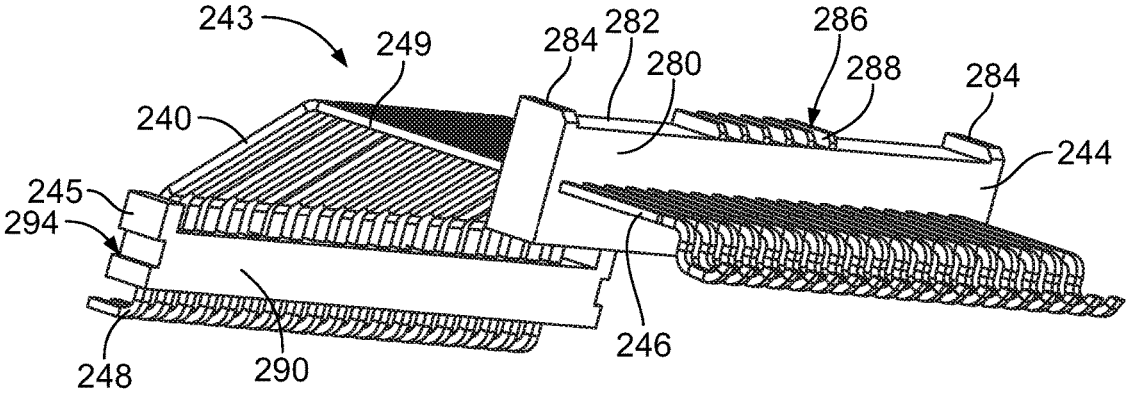
FIG. 7 is a front perspective view of a contact array of a contact assembly of the card edge connector in accordance with an exemplary embodiment.

FIG. 7 is a front perspective view of the contact array 243 in accordance with an exemplary embodiment. The other contact arrays 242, 262, 263 (shown in FIG. 6) may be similar to the contact array 243. The upper contacts 240 are held by the front contact holder 244 and the rear contact holder 245. The mating beams 246 extend forward of the front contact holder 244. The intermediate portions 249 extend between the front contact holder 244 and the rear contact holder 245. The contact tails 248 extend from the rear contact holder 245, such as from the bottom of the rear contact holder 244.

In various embodiments, the front contact holder 244 includes a dielectric body 280 overmolded around the upper contacts 240 to encase the upper contacts 240. In an exemplary embodiment, the front contact holder 244 includes locating features 284 for locating the front contact holder 244 in the contact positioner 230 and the outer housing 200 (both shown in FIG. 6). In the illustrated embodiment, the locating features 284 may be tabs extending outward from the front contact holder 244, such as from a top 282 of the front contact holder 244. Other types of locating features 284 may be used in alternative embodiments. The locating features 284 may be at other locations in alternative embodiments.

In an exemplary embodiment, the front contact holder 244 includes contact channels 286 along the top 282. The contact channels 286 are separated by separating walls 288. The contact channels 286 receive upper contacts 240 from the contact array 242 (shown in FIG. 6).

In various embodiments, the rear contact holder 245 includes a dielectric body 290 overmolded around the upper contacts 240 to encase the upper contacts 240. In an exemplary embodiment, the rear contact holder 245 includes locating features 294 for locating the rear contact holder 244 in the contact positioner 230 and/or the outer housing 200 (both shown in FIG. 6). In the illustrated embodiment, the locating features 294 are grooves formed in the sides of the rear contact holder 244. Other types of locating features 294 may be used in alternative embodiments, such as tabs extending from the sides of the rear contact holder 244. The locating features 294 may be at other locations in alternative embodiments.

Figure 8:
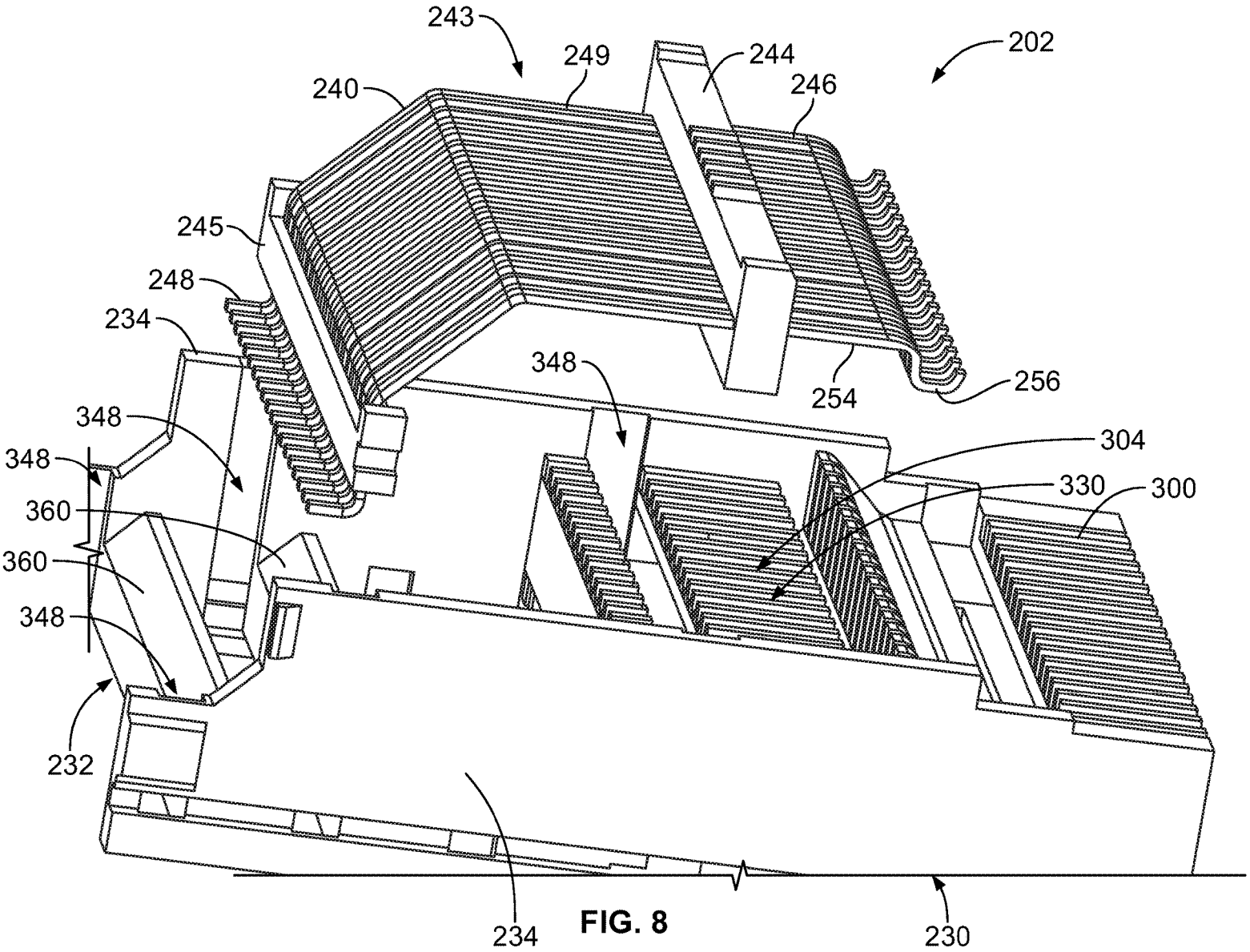
FIG. 8 is an exploded, top perspective view of a portion of the contact assembly showing a contact positioner and the contact array in accordance with an exemplary embodiment.

FIG. 8 is an exploded, top perspective view of a portion of the contact assembly 202 showing the contact positioner 230 and the upper contact array 243 poised for coupling to the contact positioner 230. The front and rear contact holders 244, 245 are aligned with the corresponding slots 348. The upper contact array 243 is configured to be loaded into the contact positioner 230 from above.

The base 232 is configured to be mounted to the host circuit board 102 (shown in FIG. 1). In an exemplary embodiment, the base 232 includes rails 360 extending between the arms 234. The rails 360 may maintain the spacing between the arms 234. The rails 360 may support the contact tails 248 or the contact tails 268 (shown in FIG. 6). Optionally, the rails 360 may include channels (not shown) that receive the contact tails 248, 268.

In an exemplary embodiment, the mating beams 246 of the upper contacts 240 of the rear upper contact array 243 are configured to be mounted to the rearward mounting area 304 of the upper wall 300. In an exemplary embodiment, the upper wall 300 includes contact channels 330 at the rearward mounting area 304 to receive the mating beams 246 of the upper contacts 240. The arms 254 and/or the fingers 256 may pass through openings in the upper wall 300 into the positioner card slot 238 (shown in FIG. 6).

The intermediate portions 249 of the upper contacts 240 are flexible between the front and rear contact holders 244, 245. As such, the mating beams 246 are independently and freely movable compared to the contact tails 248. For example, the mating beams 246 may be moved or positioned with the front contact holder 244 without moving the contact tails 248 and the rear contact holder 245, and vice versa. The mating beams 246 and the front contact holder 244 may thus be positioned independent of the contact tails 248 and the rear contact holder 245.

Figure 9:
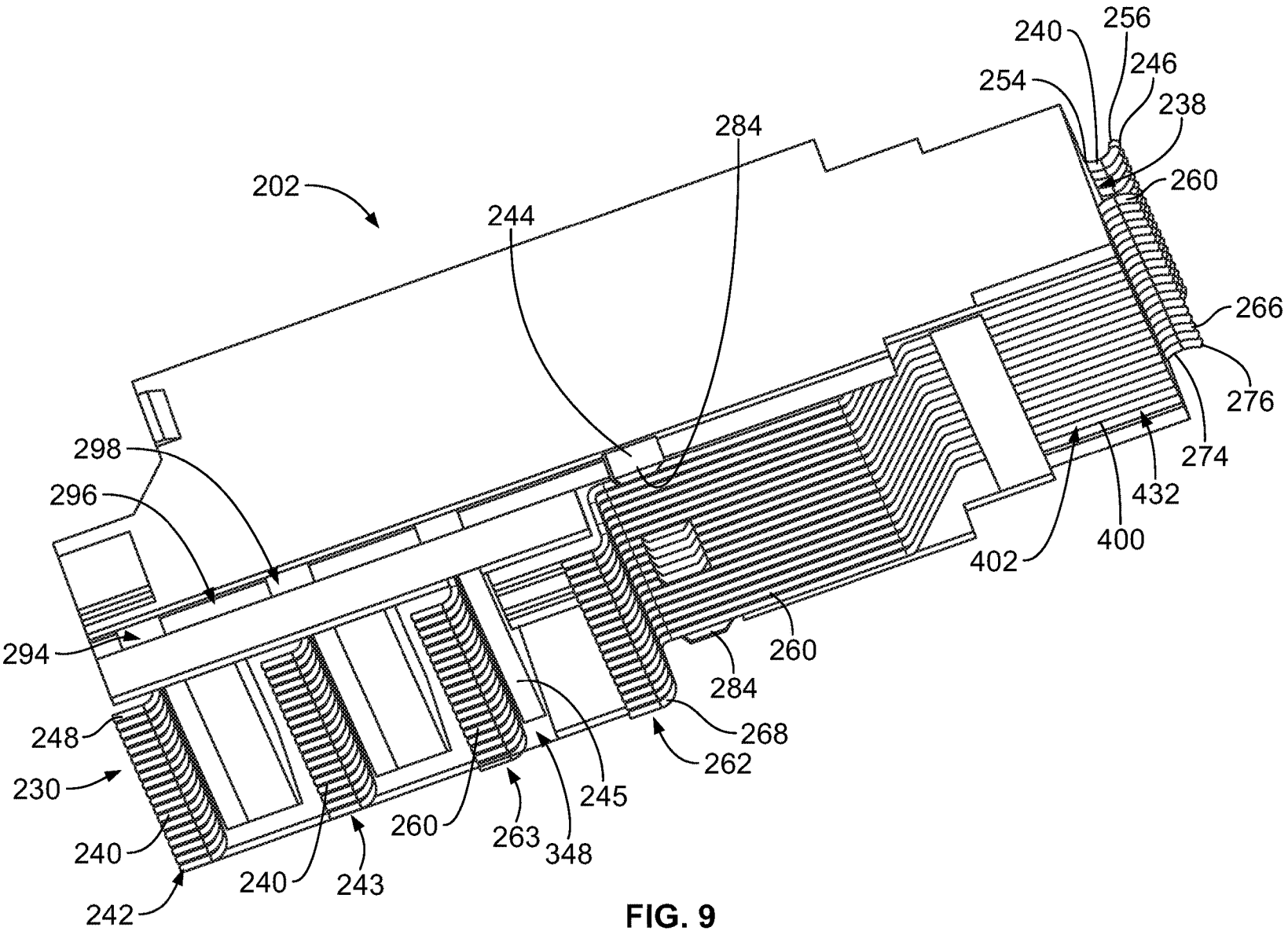
FIG. 9 is a partial bottom perspective view of the contact assembly in accordance with an exemplary embodiment.
Figure 10:
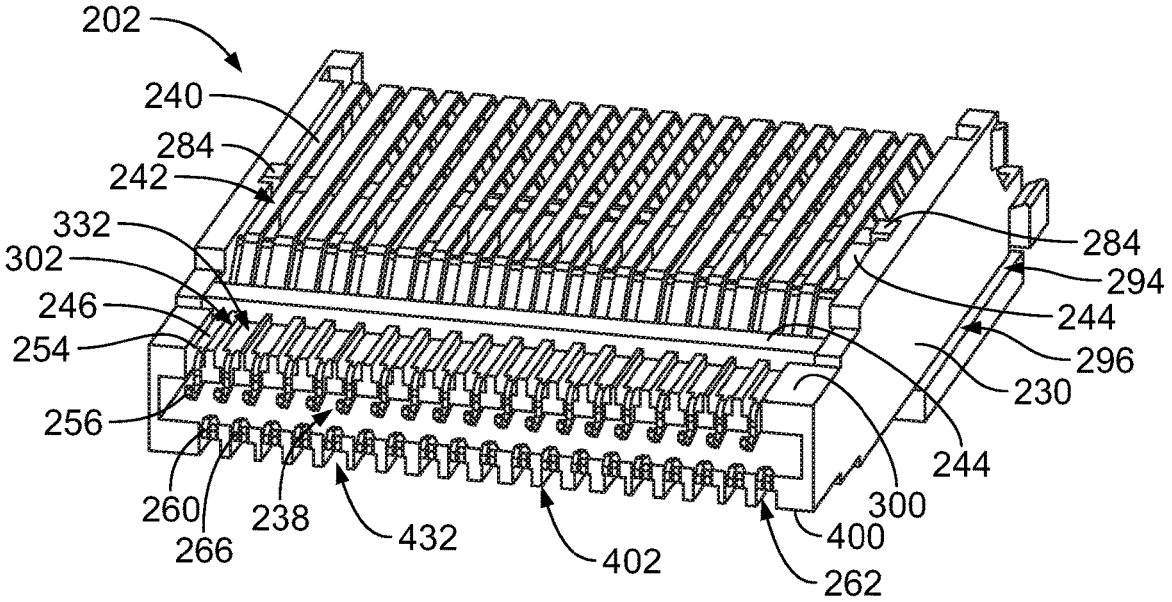
FIG. 10 is a partial front, top perspective view of the contact assembly in accordance with an exemplary embodiment.

FIG. 9 is a partial bottom perspective view of the contact assembly 202 in accordance with an exemplary embodiment. FIG. 10 is a partial front, top perspective view of the contact assembly 202 in accordance with an exemplary embodiment. The upper contact arrays 242, 243 are received in the contact positioner 230 from above. The lower contact arrays 262, 263 are received in the contact positioner 230 from below. The front contact holders 244 are received in corresponding slots 348 and the rear contact holders 245 are received in corresponding slots 348. The contact tails 248, 268 of the upper and lower contacts 240, 260 are arranged in multiple rows. In the illustrated embodiment, the contact tails 248, 268 are arranged in four rows.

With reference to FIG. 10, the mating beams 246 of the upper contacts 240 of the front upper contact array 242 are configured to be mounted to the forward mounting area 302 of the upper wall 300. In an exemplary embodiment, the upper wall 300 includes contact channels 332 at the forward mounting area 302 to receive the mating beams 246 of the upper contacts 240. The arms 254 and/or the fingers 256 may pass through openings in the upper wall 300 into the positioner card slot 238.

In an exemplary embodiment, the mating beams 266 of the lower contacts 260 of the front lower contact array 262 are configured to be mounted to a forward mounting area 402 of the lower wall 400. In an exemplary embodiment, the lower wall 400 includes contact channels 432 at the forward mounting area 402 to receive the mating beams 266 of the lower contacts 260. The arms 274 and/or the fingers 276 of the mating beams 266 may pass through openings in the lower wall 400 into the positioner card slot 238.

In an exemplary embodiment, the upper front contact holders 244 stand proud of (e.g., extend above) the upper surfaces of the sidewalls and the lower front contact holders 244 stand proud of (e.g., extend below) the lower surfaces the sidewalls. FIG. 9 shows the locating features 284 extending below the lower surfaces of the sidewalls. Similarly, FIG. 10 shows the locating features 284 extending above the upper surfaces of the sidewalls. The locating features 284 are configured to engage the outer housing 200 (shown in FIG. 6) when the contact assembly 202 is loaded into the outer housing 200 to locate the front contact holders 244 in the outer housing 200. As such, the mating beams 246, 266 of the upper and lower contacts 240, 260 are located relative to the outer housing 200 when the contact assembly 202 is loaded into the outer housing 200.

In an exemplary embodiment, the rear contact holders 245 include the locating features 294 for locating the rear contact holders 244 in the contact positioner 230 and the outer housing 200. The locating features 294 are grooves aligned with grooves 296 formed in the sides of the contact positioner 230. The locating features 294 are exposed at the grooves 296 through openings 298. The locating features 294 are configured to engage the outer housing 200 when the contact assembly 202 is loaded into the outer housing 200 to locate the rear contact holders 245 in the outer housing 200. As such, the contact tails 248, 268 of the upper and lower contacts 240, 260 are located relative to the outer housing 200 when the contact assembly 202 is loaded into the outer housing 200.

Figure 11:
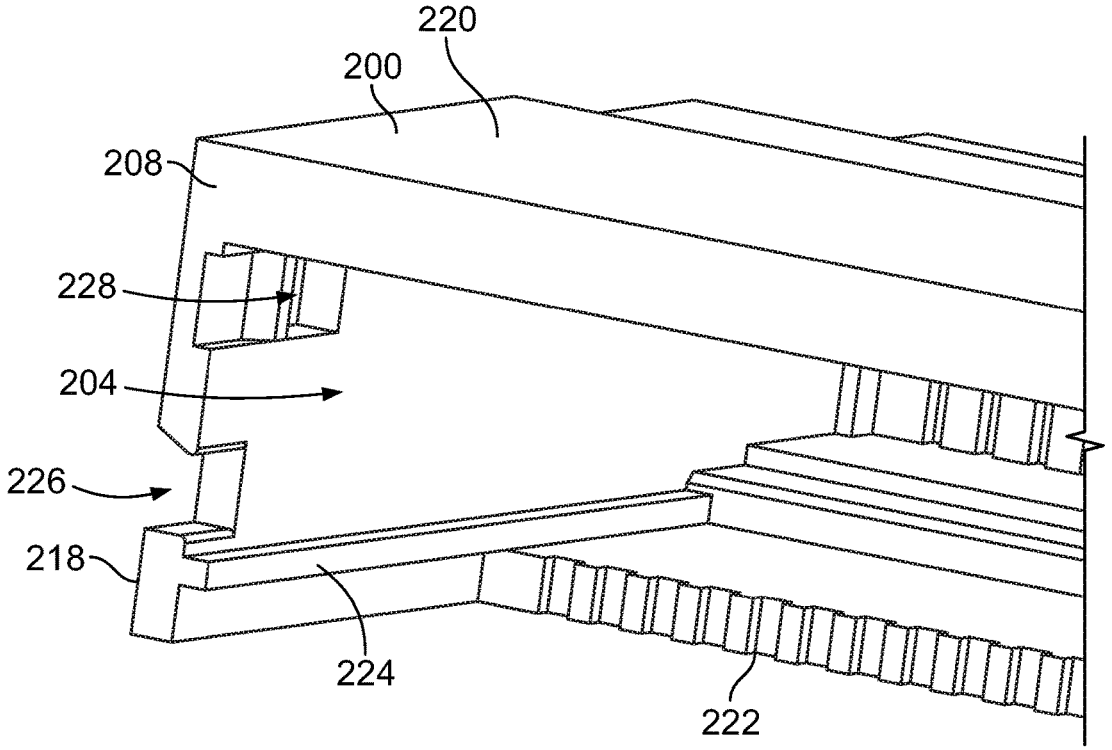
FIG. 11 is a partial rear perspective view of a portion of the outer housing in accordance with an exemplary embodiment.

FIG. 11 is a partial rear perspective view of a portion of the outer housing 200 showing the cavity 204 of the outer housing 200. The cavity 204 is located between the top wall 220 and the bottom wall 222. The outer housing 200 includes a rail 224 along the side 218 (for example, at both sides 218). The rail 224 defines a positioning feature for the outer housing 200 used to position the contact positioner 230 and/or the rear contact holders 245 (both shown in FIG. 9). The outer housing 200 includes an alignment feature 226 at the side 218 for aligning the contact positioner 230 in the cavity 204. In the illustrated embodiment, the alignment feature 226 is an opening open at the rear 208. The outer housing includes a latching feature 228 at the side 218 for securing the contact positioner 230 in the cavity 204. In the illustrated embodiment, the latching feature 228 is an opening or window and includes a catch surface at a rear of the window.

Figure 12:
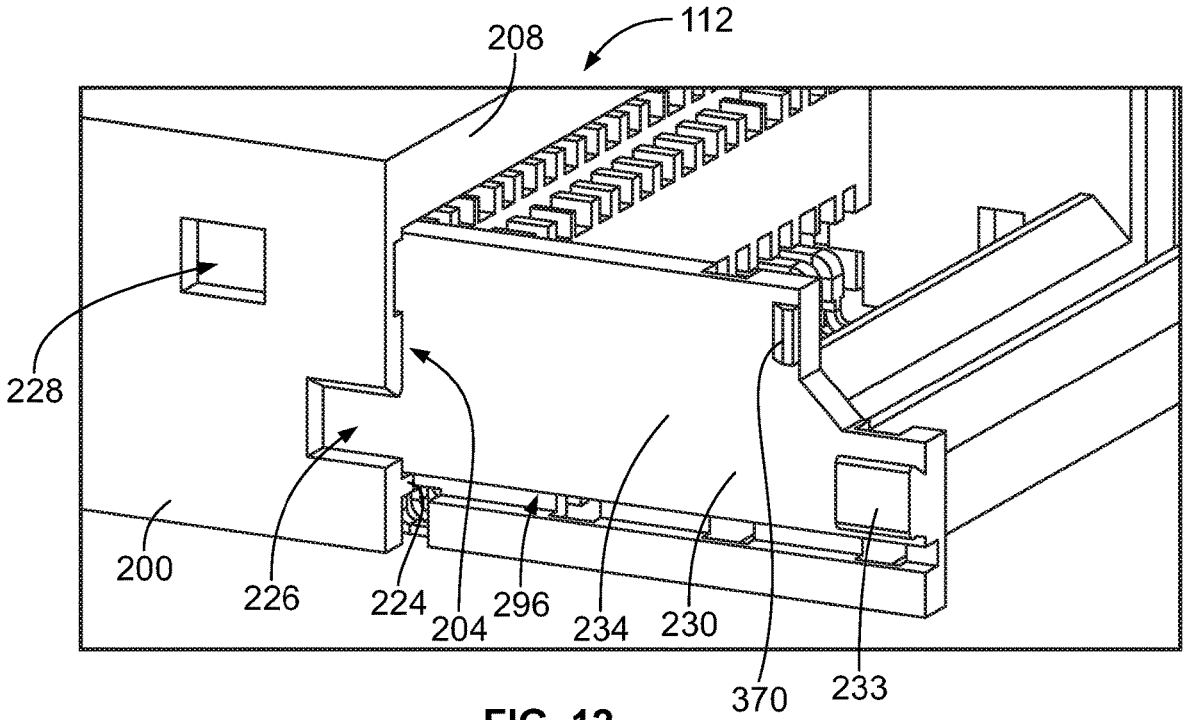
FIG. 12 is a rear perspective view of a portion of the card edge connector in accordance with an exemplary embodiment showing the contact positioner being loaded into the outer housing.
Figure 13:
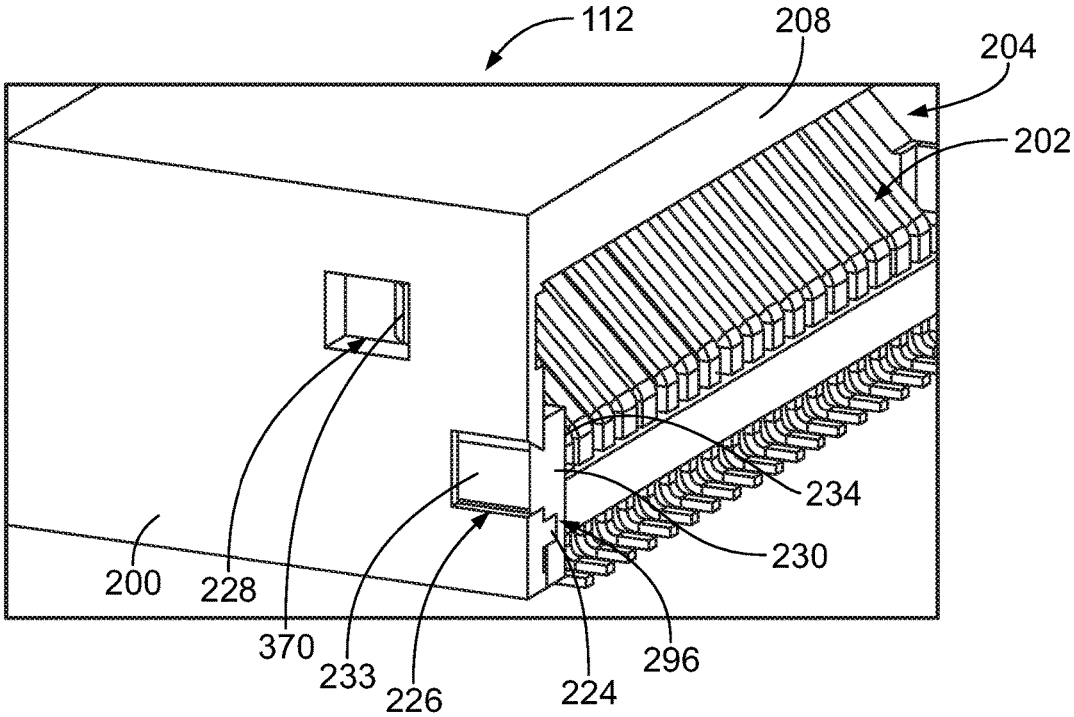
FIG. 13 is a rear perspective view of a portion of the card edge connector in accordance with an exemplary embodiment showing the contact positioner loaded into the outer housing.

FIG. 12 is a rear perspective view of a portion of the card edge connector 112 in accordance with an exemplary embodiment showing the contact positioner 230 being loaded into the outer housing 200. FIG. 13 is a rear perspective view of a portion of the card edge connector 112 in accordance with an exemplary embodiment showing the contact assembly 202 loaded into the outer housing 200. The contact positioner 230 is loaded into the cavity 204 through the rear 208. The rail 224 is aligned with and configured to be received in the groove 296 of the contact positioner 230. The alignment feature 226 of the outer housing 200 is configured to receive an alignment feature 233 extending from the arm 234. Optionally, the alignment feature 233 may be wedge-shaped, such as in the form of a dovetail. Other shapes are possible in alternative embodiments. The latching feature 228 of the outer housing 200 is configured to receive the securing feature 370 extending from the arm 234. The securing feature 370 may be a latch is configured to engage the catch surface of the latching feature 228 to retain the contact positioner 230 in the outer housing 200.

Figure 14:
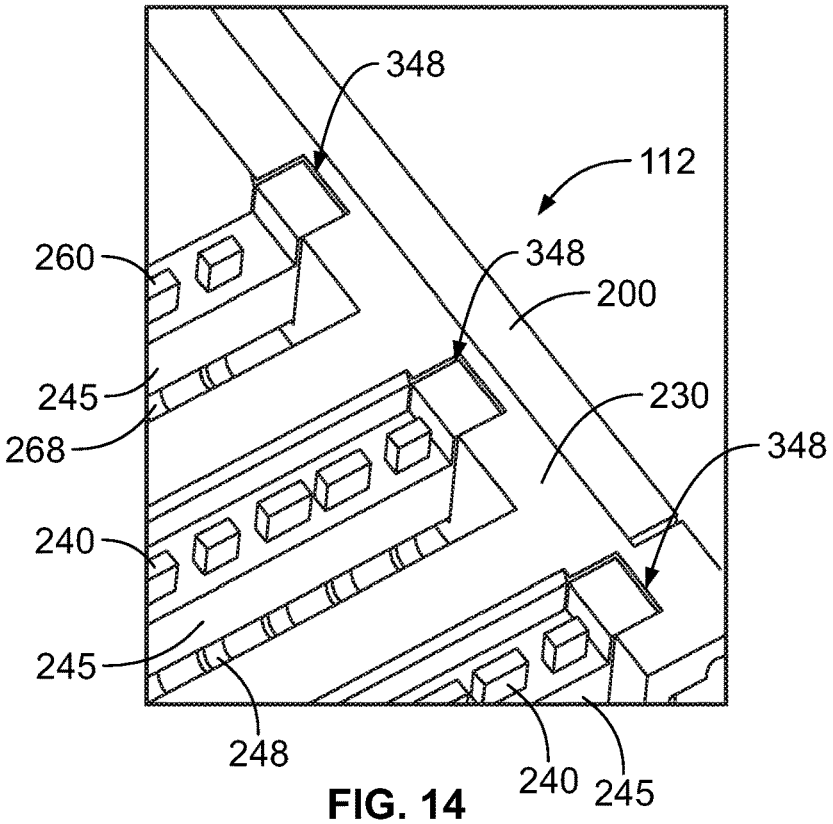
FIG. 14 is a sectional view of a portion of the card edge connector in accordance with an exemplary embodiment showing the contact positioner loaded into the outer housing.

FIG. 14 is a sectional view of a portion of the card edge connector 112 in accordance with an exemplary embodiment showing the contact positioner 230 loaded into the outer housing 200. FIG. 14 shows the rear contact holders 245 received in the slots 348. The slots 348 position the rear contact holders 245, and thus the contacts 240, 260. For example, the slots 348 hold the front-to-rear positions of the rear contact holders 245 to position the contact tails 248, 268 for mounting to the host circuit board 102 (shown in FIG. 1). In an exemplary embodiment, the rail 224 of the outer housing 200 is configured to engage the rear contact holders 245 in the slots 348 to hold vertical positions (for example, up-down positions) of the rear contact holders 245 in the slots 348.

Figure 15:
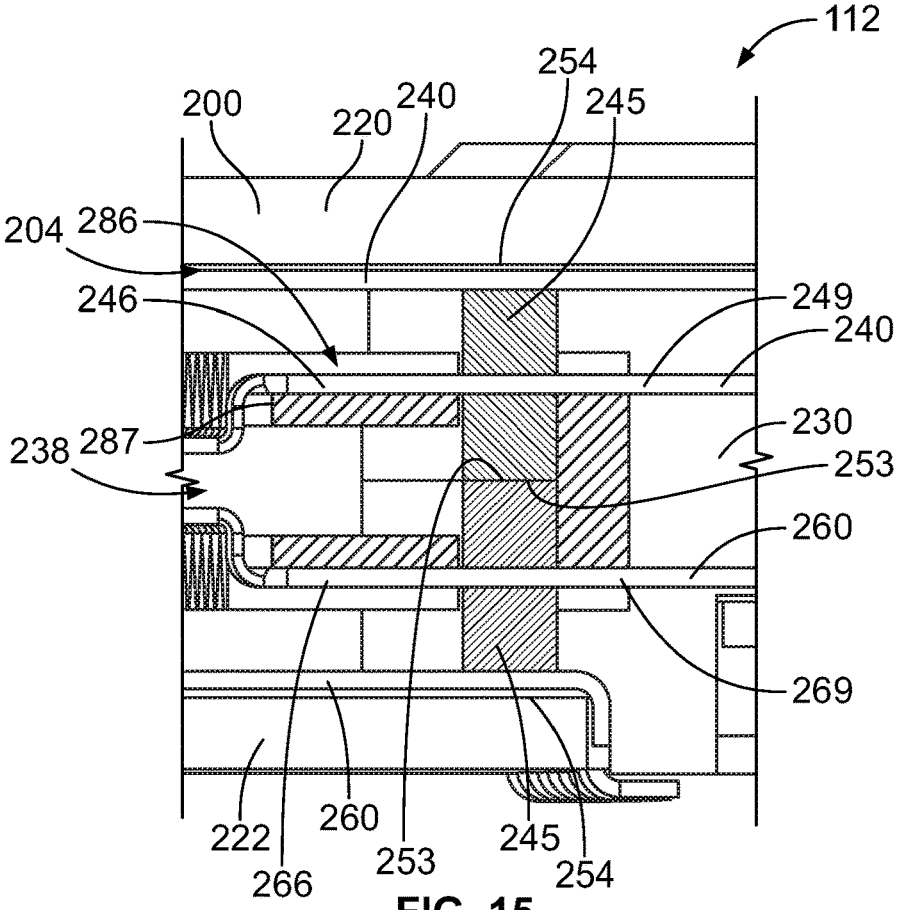
FIG. 15 is a sectional view of a portion of the card edge connector in accordance with an exemplary embodiment showing the contact positioner loaded into the outer housing.

FIG. 15 is a sectional view of a portion of the card edge connector 112 in accordance with an exemplary embodiment showing the contact positioner 230 loaded into the outer housing 200. FIG. 15 shows the front contact holders 245 positioned in the contact positioner 230. The front contact holders 245 are configured to engage the outer housing 200 to position the front contact holders 245, and thus the contacts 240, 260, in the cavity 204 of the outer housing 200 for mating with the module circuit board 176 (shown in FIG. 2). In an exemplary embodiment, the front contact holders 245 include inner surfaces 253 that abut against each other and outer surfaces 255 that engage the inner surfaces of the top wall 220 and the bottom wall 222. The intermediate portions 249, 269 extend rearward of the front contact holders 245 and are freely and independently movable. The intermediate portions 249, 269 are surrounded by air, rather than plastic, for impedance matching or tuning.

The front contact holders 245 position the mating beams 246, 266 in the cavity 204 for mating with the module circuit board 176. In an exemplary embodiment, the contact positioner 230 is used to pre-load the mating beams 246, 266. For example, the contact positioner 230 may include pre-load surfaces 287 within the contact channels 286 used to pre-load each of the upper and lower contacts 240, 260 with an internal spring biasing force for mating with the module circuit board 176. Pre-loading the upper and lower contacts 240, 260 causes the upper and lower contacts 240, 260 to be biased against the module circuit board 176 to ensure that the electrical connection between the upper and lower contacts 240, 260 and the module circuit board 176 is maintained. The upper and lower contacts 240, 260 are flexed outward by the module circuit board 176 when the module circuit board 176 is loaded in the positioner card slot 238. The internal biasing force, pre-loaded within the upper and lower contacts 240, 260, ensures that sufficient contact force is provided with small flexing of the upper and lower contacts 240, 260 by the module circuit board 176. As such, the tips of the mating beams 246, 266 may be shortened as the mating beams 246, 266 do not require as long of a lead-in surface, thus reducing electrical stub.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112(f), unless and until such claim limitations expressly use the phrase "means for" followed by a statement of function void of further structure.

What is claimed is:

1. A card edge connector for mating with a pluggable module comprising:

a housing including a top and a bottom, the housing having a front and a rear, the housing having a first side and a second side, the bottom configured to be mounted to a host circuit board, the housing including a cavity and a housing card slot open to the cavity at the front of the housing, the housing card slot configured to receive a card edge of a module circuit board of the pluggable module; and a contact assembly received in the cavity, the contact assembly having a contact positioner holding upper contacts in an upper contact array and lower contacts in a lower contact array, the contact positioner having an upper wall and a lower wall with a positioner card slot defined therebetween, the contact positioner is positioned in the cavity with the positioner card slot aligned with the housing card slot to receive the card edge of the module circuit board;

wherein the upper contacts include upper intermediate portions extending between upper mating beams and upper contact tails, the upper mating beams extending into the positioner card slot to mate with upper mating contacts of the module circuit board, the upper contact tails extending from the contact positioner for mounting to the host circuit board, the upper contact array including an upper front contact holder holding the upper contacts and an upper rear contact holder separate and discrete from the upper front contact holder holding the upper contacts, the upper front contact holder positioned between the upper mating beams and the upper intermediate portions of the upper contacts, the upper rear contact holder positioned between the upper intermediate portions and the upper contact tails of the upper contacts; and wherein the lower contacts include lower intermediate portions extending between lower mating beams and lower contact tails, the lower mating beams extending into the positioner card slot to mate with lower mating contacts of the module circuit board, the lower contact tails extending from the contact positioner for mounting to the host circuit board, the lower contact array including a lower front contact holder holding the lower contacts and a lower rear contact holder separate and discrete from the lower front contact holder holding the lower contacts, the lower front contact holder positioned between the lower mating beams and the lower intermediate portions of the lower contacts, the lower rear contact holder positioned between the lower intermediate portions and the lower contact tails of the lower contacts.

2. The card edge connector of claim 1, wherein the upper intermediate portions are flexible to allow relative movement of the upper front contact holder and the upper rear contact holder, the lower intermediate portions being flexible to allow relative movement of the lower front contact holder and the lower rear contact holder.

3. The card edge connector of claim 1, wherein the upper intermediate portions are exposed to air between the upper front contact holder and the upper rear contact holder, the lower intermediate portions being exposed to air between the lower front contact holder and the lower rear contact holder.

4. The card edge connector of claim 1, wherein the upper front contact holder is movable relative to the contact positioner and the lower front contact holder is movable relative to the contact positioner, the upper front contact holder engaging the outer housing in the cavity to position the upper front contact holder relative to the contact positioner and the outer housing to position the upper mating beams relative to the positioner card slot and the housing card slot for mating with the module circuit board, the lower front contact holder engaging the outer housing in the cavity to position the lower front contact holder relative to the contact positioner and the outer housing to position the lower mating beams relative to the positioner card slot and the housing card slot for mating with the module circuit board.

5. The card edge connector of claim 1, wherein the contact positioner includes front slots receiving the upper front contact holder and the lower front contact holder to position the upper and lower mating beams relative to the positioner card slot, the contact positioner including rear slots receiving the upper rear contact holder and the lower rear contact holder to position the upper and lower contact tails relative to the outer housing for terminating to the host circuit board.

6. The card edge connector of claim 1, wherein the upper front contact holder includes an overmold body encasing each of the upper contacts, the upper rear contact holder includes an overmold body encasing each of the upper contacts, the lower front contact holder includes an overmold body encasing each of the lower contacts, the lower rear contact holder includes an overmold body encasing each of the lower contacts.

7. The card edge connector of claim 1, wherein the upper wall includes pre-load beams engaging the upper mating beams of the upper contacts to pre-load the upper contacts in an inward biasing direction, the lower wall having pre-load beams engaging the lower mating beams of the lower contacts to pre-load the lower contacts in an inward biasing direction.

8. The card edge connector of claim 1, wherein the upper wall and the lower wall are fixed relative to each other on opposite sides of the positioner card slot, the upper mating beams and the lower mating beams being moved away from each other when mated with the module circuit board.

9. The card edge connector of claim 1, wherein the upper wall includes impedance control air voids between upper mating beams, upper intermediate portions, lower mating beams and lower intermediate portions.

10. The card edge connector of claim 1, wherein the upper mating beams and the lower mating beams extend forward of the contact positioner into housing contact channels of the housing.

11. The card edge connector of claim 1, wherein the contact positioner includes a first side wall and a second side wall, the contact positioner includes an upper positioning rail extending between the first and second side walls, the upper positioning rail including upper positioning tabs with upper contact channels therebetween, the upper contact channels receiving corresponding upper contacts to position the upper contacts relative to each other, the contact positioner including a lower positioning rail extending between the first and second side walls, the lower positioning rail including lower positioning tabs with lower contact channels therebetween, the lower contact channels receiving corresponding lower contacts to position the lower contacts relative to each other.

12. A card edge connector for mating with a pluggable module comprising:

a housing including a top and a bottom, the housing having a front and a rear, the housing having a first side and a second side, the bottom configured to be mounted to a host circuit board, the housing including a cavity and a housing card slot open to the cavity at the front of the housing, the housing card slot configured to receive a card edge of a module circuit board of the pluggable module; and a double sided, multi-row contact assembly received in the cavity, the double sided, multi-row contact assembly having a contact positioner holding contact arrays of contacts, the contact arrays including a first upper contact array with the contacts thereof arranged in a first upper row, a second upper contact array with the contacts thereof arranged in a second upper row, a first lower contact array with the contacts thereof arranged in a first lower row, and a second lower contact array with the contacts thereof arranged in a second lower row, the contact positioner having an upper wall supporting the first and second upper rows of contacts and a lower wall supporting the first and second lower rows of contacts, the contact positioner including a positioner card slot between the upper wall and the lower wall, the contact positioner is positioned in the cavity of the outer housing with the positioner card slot aligned with the housing card slot to receive the card edge of the module circuit board, each contact includes an intermediate portion extending between a mating beam and a contact tail, the mating beams being aligned in the corresponding first and second upper rows and the corresponding first and second lower rows, the mating beams extending into the positioner card slot to mate with the module circuit board, the contact tails extending from the contact positioner for mounting to the host circuit board, each contact array includes a front contact holder and a rear contact holder separate and discrete from the front contact holder, the front contact holder positioned between the mating beams and the intermediate portions of the corresponding contacts, the rear contact holder positioned between the intermediate portions and the contact tails of the corresponding contacts;

wherein the front contact holders are movably coupled to the contact positioner, the front contact holders engaging the outer housing in the cavity to position the front contact holders relative to the contact positioner and the outer housing to position the mating beams relative to the positioner card slot and the housing card slot for mating with the module circuit board.

13. The card edge connector of claim 12, wherein the intermediate portions are flexible to allow relative movement of the front contact holder and the rear contact holder.

14. The card edge connector of claim 12, wherein the contact positioner includes front slots receiving the front contact holders to position the mating beams relative to the positioner card slot, and the contact positioner includes rear slots receiving the rear contact holders to position the contact tails relative to the outer housing for terminating to the host circuit board.

15. The card edge connector of claim 12, wherein each front contact holder includes an overmold body encasing the corresponding contacts, the overmold body including a positioning surface engaging the outer housing to position the overmold body relative to the outer housing.

16. The card edge connector of claim 12, wherein the contact positioner includes pre-load beams engaging the mating beams to pre-load the mating beams in an inward biasing direction for mating with the module circuit board.

17. The card edge connector of claim 12, wherein the upper wall and the lower wall includes impedance control air voids between the mating beams and the intermediate portions.

18. A card edge connector for mating with a pluggable module comprising:

a housing including a top and a bottom, the housing having a front and a rear, the housing having a first side and a second side, the bottom configured to be mounted to a host circuit board, the housing including a cavity and a housing card slot open to the cavity at the front of the housing, the housing card slot configured to receive a card edge of a module circuit board of the pluggable module; and a double sided, multi-row contact assembly received in the cavity, the contact assembly having a contact positioner holding a first upper contact array and a second upper contact array and holding a first lower contact array and a second lower contact array, the contact positioner having an upper wall and a lower wall with a positioner card slot defined therebetween, the contact positioner is positioned in the cavity with the positioner card slot aligned with the housing card slot to receive the card edge of the module circuit board;

wherein the first upper contact array includes first upper contacts, a first upper front contact holder, and a first upper rear contact holder, the first upper rear contact holder being separate and discrete from the first upper front contact holder, the first upper contacts including first upper intermediate portions extending between first upper mating beams and first upper contact tails, the first upper mating beams arranged in a first upper row and extending into the positioner card slot to mate with first upper mating contacts of the module circuit board, the first upper contact tails extending from the contact positioner for mounting to the host circuit board, the first upper front contact holder positioned between the first upper mating beams and the first upper intermediate portions to hold each of the first upper contacts, the first upper rear contact holder positioned between the first upper intermediate portions and the first upper contact tails to hold each of the first upper contacts;

wherein the second upper contact array includes second upper contacts, a second upper front contact holder, and a second upper rear contact holder, the second upper rear contact holder being separate and discrete from the second upper front contact holder, the second upper contacts including second upper intermediate portions extending between second upper mating beams and second upper contact tails, the second upper mating beams arranged in a second upper row parallel to and spaced apart from the first upper row, the second upper mating beams extending into the positioner card slot to mate with second upper mating contacts of the module circuit board, the second upper contact tails extending from the contact positioner for mounting to the host circuit board, the second upper front contact holder positioned between the second upper mating beams and the second upper intermediate portions to hold each of the second upper contacts, the second upper rear contact holder positioned between the second upper intermediate portions and the second upper contact tails to hold each of the second upper contacts;

wherein the first lower contact array includes first lower contacts, a first lower front contact holder, and a first lower rear contact holder, the first lower rear contact holder being separate and discrete from the first lower front contact holder, the first lower contacts including first lower intermediate portions extending between first lower mating beams and first lower contact tails, the first lower mating beams arranged in a first lower row and extending into the positioner card slot to mate with first lower mating contacts of the module circuit board, the first lower contact tails extending from the contact positioner for mounting to the host circuit board, the first lower front contact holder positioned between the first lower mating beams and the first lower intermediate portions to hold each of the first lower contacts, the first lower rear contact holder positioned between the first lower intermediate portions and the first lower contact tails to hold each of the first lower contacts; and wherein the second lower contact array includes second lower contacts, a second lower front contact holder, and a second lower rear contact holder, the second lower rear contact holder being separate and discrete from the second lower front contact holder, the second lower contacts including second lower intermediate portions extending between second lower mating beams and second lower contact tails, the second lower mating beams arranged in a second lower row parallel to and spaced apart from the first lower row, the second lower mating beams extending into the positioner card slot to mate with second lower mating contacts of the module circuit board, the second lower contact tails extending from the contact positioner for mounting to the host circuit board, the second lower front contact holder positioned between the second lower mating beams and the second lower intermediate portions to hold each of the second lower contacts, the second lower rear contact holder positioned between the second lower intermediate portions and the second lower contact tails to hold each of the second lower contacts.

19. The card edge connector of claim 18, wherein the first upper intermediate portions are flexible to allow relative movement of the first upper front contact holder and the first upper rear contact holder, the second upper intermediate portions are flexible to allow relative movement of the second upper front contact holder and the second upper rear contact holder, the first lower intermediate portions are flexible to allow relative movement of the first lower front contact holder and the first lower rear contact holder, and the second lower intermediate portions are flexible to allow relative movement of the second lower front contact holder and the second lower rear contact holder.

20. The card edge connector of claim 18, wherein the first and second upper front contact holders are movable relative to the contact positioner and the first and second lower front contact holders are movable relative to the contact positioner, the first and second upper front contact holders engaging the outer housing in the cavity to position the first and second upper front contact holders relative to the contact positioner and the outer housing, the first and second lower front contact holders engaging the outer housing in the cavity to position the first and second lower front contact holders relative to the contact positioner and the outer housing.

* * * * *